United States Patent [19]

Kirwan et al.

[11] Patent Number: 5,017,064

[45] Date of Patent: May 21, 1991

[54] INTERMODAL TRANSPORT SYSTEM

[76] Inventors: George B. Kirwan, 1940 Old Miller Rd., Huntington, W. Va. 25701; Victor A. Nelson, 5514 Flag Run Dr., Springfield, Va. 22151

[21] Appl. No.: 411,659

[22] Filed: Sep. 25, 1989

[51] Int. Cl.[5] ..... B61D 3/14; B65F 9/00; B60T 3/00

[52] U.S. Cl. ..... 410/53; 188/32; 414/333; 410/52; 410/56; 410/65

[58] Field of Search ..... 414/333, 337-340, 414/349, 352, 348, 342, 373; 188/32; 410/1, 52, 53, 57, 60, 65

[56] References Cited

U.S. PATENT DOCUMENTS

| | | | |
|---|---|---|---|
| 2,585,126 | 2/1952 | Holland | 188/32 |
| 3,338,338 | 8/1967 | Lindeen | 188/32 |
| 3,576,167 | 4/1971 | Macomber | 410/57 |
| 4,141,300 | 2/1979 | Marulic et al. | 410/57 |
| 4,179,997 | 12/1979 | Kirwan | 414/333 |

FOREIGN PATENT DOCUMENTS

| | | | |
|---|---|---|---|
| 221664 | 9/1957 | Australia | 188/32 |
| 1455317 | 1/1969 | Fed. Rep. of Germany | 414/333 |

*Primary Examiner*—Joseph F. Peters, Jr.
*Assistant Examiner*—R. B. Johnson
*Attorney, Agent, or Firm*—Daniel J. O'Connor

[57] ABSTRACT

An intermodal transport system designed for use in the hauling of semi-trailers by means of railway bogies. The system combines a turntable and spring-loaded chock design to enable the efficient loading and unloading of semi-trailers. A novel turntable design reduces bending stresses in transit while the combined chock reduces labor requirements during the loading and unloading processes since an automatic locking in place is achieved.

8 Claims, 4 Drawing Sheets

INTERMODAL TRANSPORT SYSTEM

BACKGROUND AND OBJECTS OF THE INVENTION

This invention relates generally to the transport of semi-trailers by rail.

Such intermodal transport has become increasingly important in urban areas where freight shippage requirements are high and there is a concurrent need to reduce semi-trailer traffic on busy expressways.

Many urban areas, citing increased road damage and traffic accidents, have introduced legislation which heavily taxes and regulates truck traffic. The transport of semi-trailers by rail has thus found widespread use in the freight shipping arts.

The loading, unloading and safe transport of semi-trailers by rail have posed significant problems with prior art systems.

U.S. Pat. No. 4,653,966 illustrates a system wherein a semi-trailer is driven onto a bogie. Such system requires a large truck turning area and a high degree of driver skill to accomplish the loading process. Further, various locking adjustments must be made after loading to secure the semi-trailer to the bogie. Such requirements, due to the time and labor costs involved, have been found to be unsatisfactory in the intermodal transport arts.

U.S. Pat. No. 4,574,707 illustrates the prior art use of lifting, apparently via crane, a semi-trailer onto a rail bogie for transport. Such system requires a very costly multiple spring-type design and still does not achieve the desired securing function for the load to be carried.

U.S. Pat. No. 2,992,621 is an older design which generally illustrates the use of turntables in the railroad trailer transport arts.

In view of the known prior art systems, it is accordingly an object of the present invention to demonstrate a railway bogie which may be economically manufactured without the complexities inherent in prior art designs.

It is a further object of the invention to produce an intermodal transport system which may be efficiently used without the labor-intensive load securing requirements currently in use.

It is also an object of the invention to demonstrate a design wherein the longitudinal movement of a trailer is automatically restrained without the need for costly lock-down requirements of the prior art.

It is a still further object of the invention to provide a low-riding, close to the rail pivoting system which insures maximum stability and protection for the transported load.

These and other objects and advantages of the invention will be apparent to those of skill in the art from the description which follows.

SUMMARY OF THE INVENTION

The present design is of the type wherein the semi-trailer is crane-loaded onto bogies which are suitably spaced apart.

The fifth wheel of the semi-trailer is lowered onto a rear portion of a bogie for support thereon. Simultaneously, the rear wheels of the trailer are lowered onto a forward portion of a second nearby bogie.

The forward portion of each bogie has a turntable assembly formed thereon which has wheel-receiving channels.

A novel chock assembly is permanently positioned in the wheel-receiving channels and is constructed such that the trailer wheels may be simply lowered onto and over the chock.

The chock assembly is spring loaded such that there is an automatic setting of the trailer wheels relative t the front portion of the bogie.

The deep well construction of the turntable assembly and the automatically setting chock design reduces time and labor requirements for loading while simultaneously insuring that the load will be securely carried.

The combined turntable and spring-loaded chock assembly has not been heretofore known in the prior art.

BRIEF DESCRIPTION OF THE DRAWING FIGURES

DESCRIPTION OF THE PREFERRED EMBODIMENT

Figure 1:
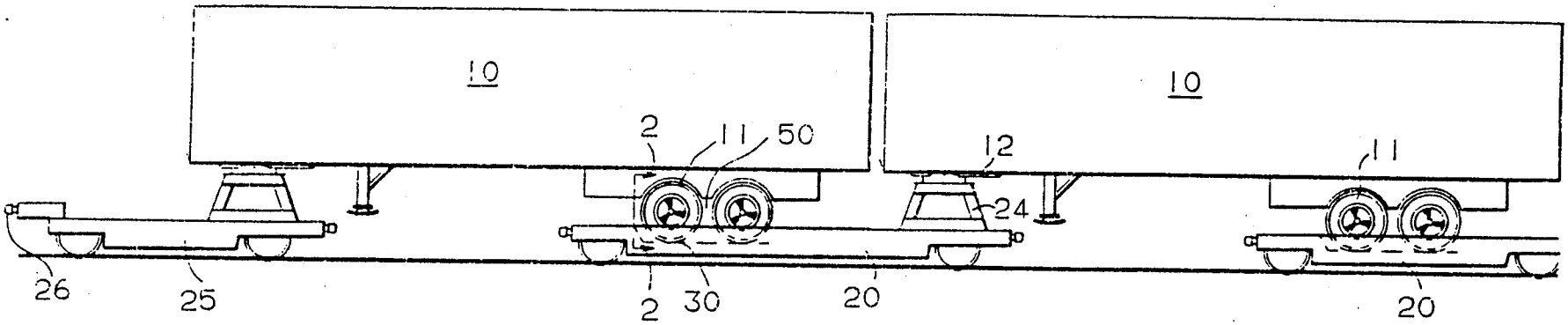
FIG. 1 is a schematic view of the semi-trailers in the loaded position relative to the transport bogies.

As shown in the central part of FIG. 1, each of the bogies 20 of the present invention has a rear elevated structure 24 upon which the fifth wheel assembly 12 of a trailer 10 may be mounted for transport.

As further shown in FIG. 1, each bogie 20 has a front portion containing a turntable assembly 30 for carriage of the rear wheels 11 of a trailer 10.

Figure 2:
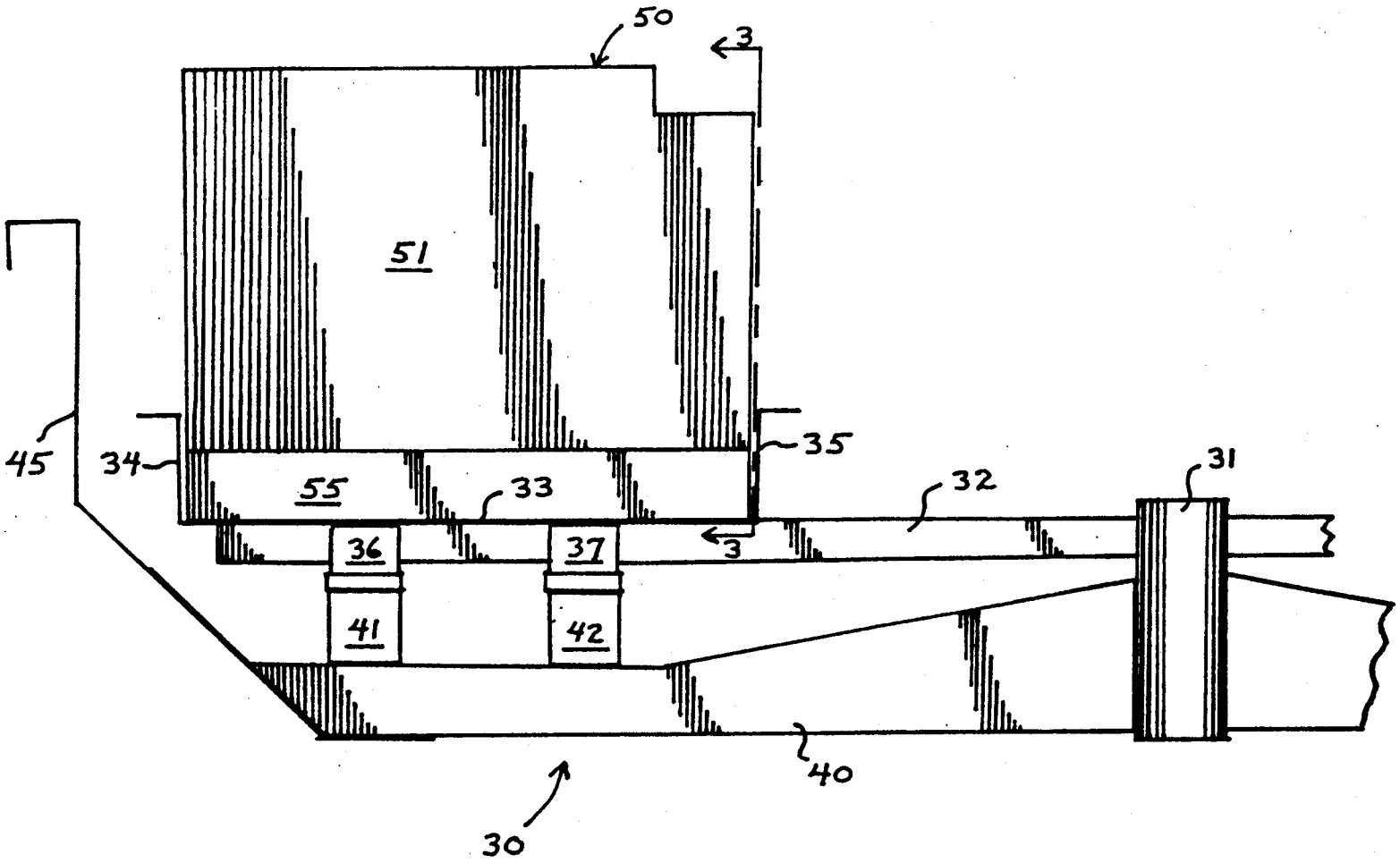
FIG. 2 is an end view of the main components of the turntable assembly which is positioned at the front portion of the bogie. It is a view along lines 2—2 of FIG. 1 with the trailer wheels not shown for clarity.
Figure 4:
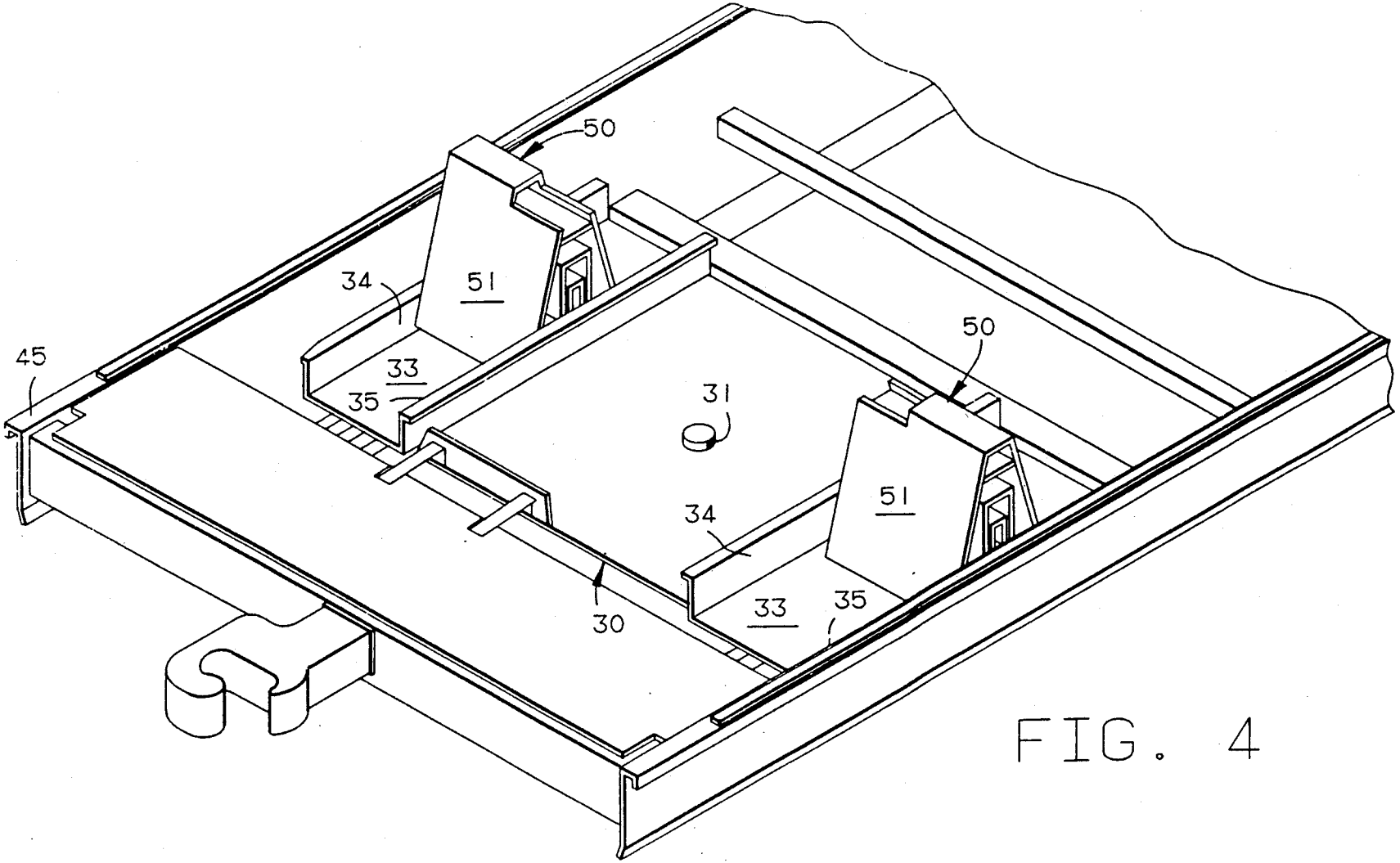
FIG. 4 is an isometric view of the upper front portion of a bogie which illustrates the position of spring-loaded chocks relative to the turntable assembly.
Figure 3:
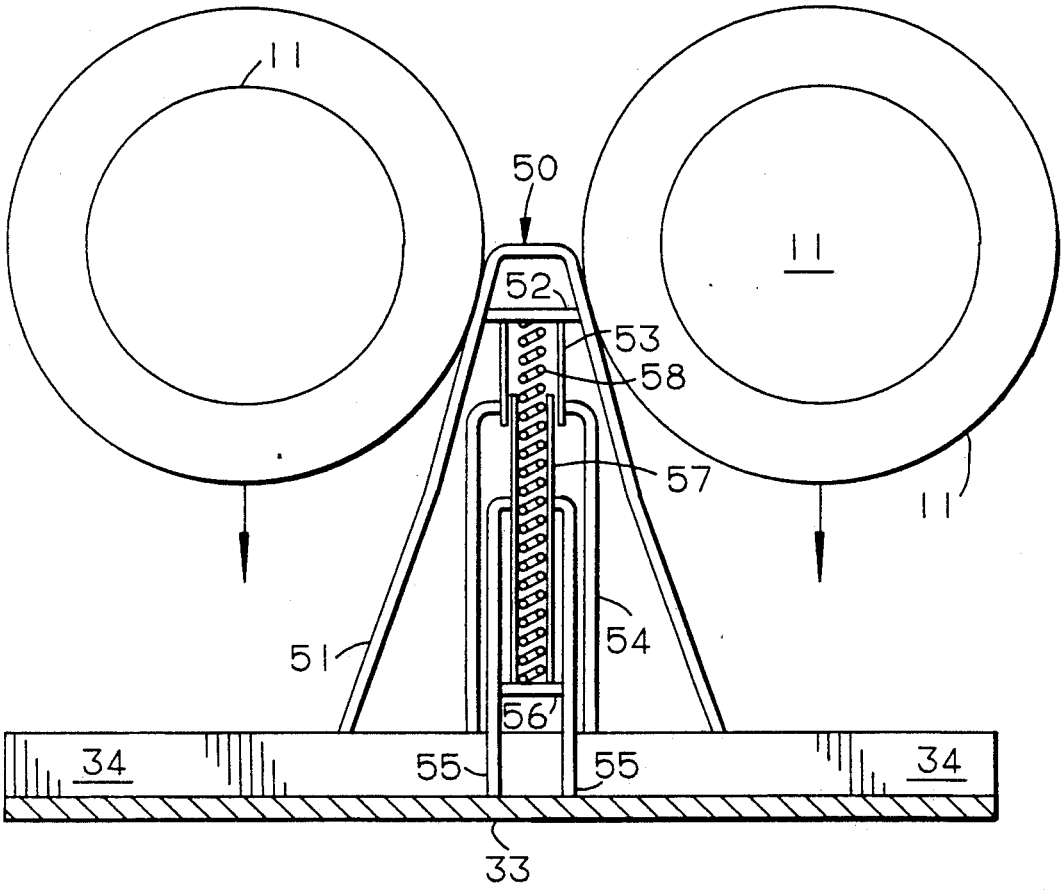
FIG. 3 is a side view of the chock assembly which best illustrates the construction and advantageous operation thereof. It is a view along lines 3—3 of FIG. 2.

Mounted as a part of the turntable 30 is a chock assembly located in the region of numeral 50 and described more fully with reference to FIGS. 2, 3 and 4.

The lead bogie 25 of FIG. 1 has a coupler 26 for attachment to the locomotive while the couplers of bogies 20 are of a non-standard height to prevent coupling with standard railcars for safety reasons.

Referring now to FIG. 2 which shows a partial end view of the bogie and turntable assembly 30, the turntable pivots about a central pin 31. It is to be understood that pin 31 is located in the middle of the bogie and thus pulling forces are transmitted thereto as will be described.

The turntable assembly 30 includes a support arm 32 extending outwardly to a wheel-receiving compartment 33. The wheel-receiving compartment 33 has upstanding lateral edges 34 and 35 to prevent excess side-to-side motion of the truck wheels 11 when mounted onto the turntable.

The wheel-receiving compartment 33 further has lower tubular support elements 36 and 37 upon which friction pads or bearings are mounted to accomplish the turntable function.

The turntable support assembly 40 also extends outwardly from the region of central pin 31 and has tubular support elements 41 and 42 mounted thereon to provide support to the upper tubular elements 36 and 37.

The bogie side walls 45 are also illustrated in FIG. 2 as being mounted to the turntable support assembly 40. As will be appreciated by those of skill in the art, such low-riding bogie construction results in a high degree of stability for the trailer being transported.

The chock assembly 50 is also shown in FIG. 2 as being mounted on the wheel-receiving compartment 33. In the view of FIG. 2, the chock outer cover element 51 and the chock stationary guide 55 are shown and will be further described with reference to FIG. 3.

Referring now to the schematic operating diagram of FIG. 3, it will be appreciated that the chock assembly 50 is fixed at a position near the middle of the wheel-receiving compartment 33. This position is such that the truck wheels 11 descend down over the chock assembly 50 when loading a previously noted with reference to FIG. 1.

As shown in FIG. 3, the chock cover 51 has a horizontal upper spring retaining element 52 and an upper spring housing 53 mounted thereto. Further, a movable guide element 54 is attached to the upper spring housing 53.

A stationary guide 55 is fixedly mounted to the wheel-receiving compartment 33. The stationary guide 55 has a horizontal lower spring retaining element 56 mounted thereto. A lower spring housing 57 is further attached to element 56.

As will be appreciated from the view of FIG. 3, the legs of the chock cover 51 are curved outwardly so as to accommodate receipt of trailer wheels 11 when lowered upon them.

When such loading occurs, the chock cover 51 causes spring 58 to be compressed, the movable guide element 54 is also lowered around the stationary guide 55 and the wheels 11 eventually come to rest in the wheel-receiving compartment 33.

The truck wheels are thus automatically secured via the spring-loaded chock action from any longitudinal movement. The tight fit of the trailer wheels against the chock thus takes the slack out of the entire bogie system so that the traditionally encountered start and stop slack forces are eliminated.

The fact that the spring-loaded chock is mounted on the wheel-receiving turntable 33 also mean that the trailers 10 ar much less subject to bending stresses as the bogie system encounters turns in the railway track.

FIG. 4 illustrates further the position of chocks 50 at or near the midpoint of wheel-receiving compartments 33.

FIG. 4, showing the front upper portions of each bogie 20, also illustrates the lateral walls 34 and 35 in each wheel-receiving compartment 33 and the central pin 31 for the turntable assembly 30.

The lateral walls 34 and 35 serve to prevent lateral motion of a semi-trailer during transport as a further safety feature.

From the illustrations of the central pin 31 in FIG. 4 and 2, it will be appreciated that a large portion of the forces extant during transport are transferred to the middle part of the bogies, thus lowering potentially damaging shearing forces and adding non-tipping stability to the overall bogie unit.

From the foregoing description, it will be apparent that at least one spring 58 is utilized in each chock assembly 50. In the preferred practice of the invention, two springs 58 are used in each chock 50. Of course, the number and strength of springs 58 may vary depending upon the particular loading conditions encountered.

While a particular preferred embodiment of the invention has been illustrated and described, it is intended in this specification and appended claims to cover all changes and modifications which fall within the spirit and scope of the invention set forth.

We claim:

1. An intermodal transportation system for use in combination with semi-trailers (10) and railway bogies wherein said semi-trailers (10) have a fifth wheel (12) on the front thereof and wheels (11) on the rear thereof, wherein said railway bogie has a rear portion (24) which is elevated to receive a fifth wheel of a first of said semi-trailers (10), wherein said railway bogie has a front portion with a turntable means (30) mounted thereon for receipt of the rear wheels (11) of a second of said semi-trailers, wherein said turntable means (30) has a spring-loaded chock (50) mounted thereon to provide means wherein said wheels (11) may be automatically held against longitudinal movement, wherein said turntable (30) has a wheel-receiving compartment (33) formed on the top portion thereof, wherein said wheel-receiving compartment has lateral edges (34, 35) formed thereon to prevent side-to-side motion of the wheels (11) once loaded onto said bogie, wherein said chock (50) is mounted to said wheel-receiving compartment (33), wherein said chock (50) is mounted at substantially the midpoint of said wheel-receiving compartment, wherein said chock (50) has an outer cover element (51) with an upper spring retaining element (52) mounted thereto.

2. The system of claim 1 wherein said chock (50) includes a lower stationary guide means (55) which is mounted to the wheel-receiving compartment (33).

3. The system of claim 2 wherein said lower stationary guide means (55) has a lower spring retaining element (56) mounted thereto.

4. The system of claim 3 wherein at least one spring (58) extends between said upper spring retaining element (52) and said lower spring retaining element (56).

5. The system of claim 4 wherein an upper spring housing (53) is mounted to said upper spring retaining element (52).

6. The system of claim 5 wherein a movable guide means (54) is attached to said upper spring housing (53) and is positioned in surrounding relation to said stationary guide means (55).

7. The system of claim 6 wherein a lower spring housing (57) is mounted to said lower spring retaining element (56).

8. The system of claim 1 wherein each bogie (20) has a central pin (31) positioned therein and wherein said turntable means (30) rotates about said central pin (31).

* * * * *